United States Patent [19]

Shibata et al.

[11] 4,221,640

[45] Sep. 9, 1980

[54] METHOD OF TREATING A SURFACE OF AN ALUMINUM OR ALUMINUM ALLOY

[75] Inventors: Kizo Shibata, Takaoka; Ichiro Ootsuka, Toyama; Shyoichi Anada; Kunio Wakasugi, both of Takaoka, all of Japan

[73] Assignee: Hokusei Aluminum Company Ltd., Takaoka, Japan

[21] Appl. No.: 895,725

[22] Filed: Apr. 12, 1978

Related U.S. Application Data

[63] Continuation of Ser. No. 737,007, Oct. 29, 1976, abandoned.

[30] Foreign Application Priority Data

Nov. 13, 1975 [JP] Japan ..... 50/136485
Mar. 12, 1976 [JP] Japan ..... 51/27556

[51] Int. Cl.[2] ..... C25D 11/06; C25D 11/08; C25D 11/10; C25D 11/22

[52] U.S. Cl. ..... 204/33; 204/35 N; 204/42; 204/58

[58] Field of Search ..... 204/33, 129.75, 0.4, 204/35 N, 58, 42, 49

[56] References Cited

U.S. PATENT DOCUMENTS 1,515,658 11/1924 Cole ..... 204/33
1,735,286 11/1929 Kujirai et al. ..... 204/58
1,735,509 11/1929 Setoh et al. ..... 204/58

FOREIGN PATENT DOCUMENTS 1302285 7/1962 France ..... 204/129.75
226536 10/1925 United Kingdom ..... 204/58

OTHER PUBLICATIONS

"Surface Treatment of Al," Wernick et al., 1964, pp. 252–253.

"Electrolytic Alkaline Cleaning," *The Surface Treatment & Finishing of Al* by S. Wernick et al., 3rd ed., 1964, pp. 171–173, 192.

*Primary Examiner*—R. L. Andrews
*Attorney, Agent, or Firm*—Stevens, Davis, Miller & Mosher

[57] ABSTRACT

An aluminum or aluminum alloy is electrolyzed in an electrolytic bath composed of an aqueous solution containing at least one of hydroxides and salts of alkali or alkaline earth metal and further optionally including at least one substance capable of forming barrier-type layer selected from the group consisting of inorganic acids, organic acids and ammonium salts of weak acids by applying an alternating current to form a grain-like or wooden like pattern on the surface thereof. The thus obtained grain-like pattern may be directly subjected to usual coloration treatments or may be anodically oxidized prior to the usual coloration treatment.

6 Claims, 2 Drawing Figures

METHOD OF TREATING A SURFACE OF AN ALUMINUM OR ALUMINUM ALLOY

This is a continuation of application Ser. No. 737,007, filed Oct. 29, 1976, now abandoned.

BACKGROUND OF THE INVENTION

1. Field of the Invention

The present invention relates to a method of treating a surface of an aluminum or aluminum alloy (hereinafter referred to as an aluminum article), and more particularly to a method of forming grain-like or wooden like patterns on the surface of the aluminum article.

2. Description of the Prior Art

Heretofore, various patterns such as grain-like pattern and so on have been formed on the surface of the aluminum article by any one of the following methods:

(A) a method of embossing given pitches on the surface of the aluminum article with a transfer roller or a press molding tool;

(B) a method of etching the surface of the aluminum material into a pattern corresponding to an original with chemicals by a photoengraving process;

(C) a method of partially masking the surface of the aluminum material with an appropriate protective material so as to conduct spraying and baking of a paint or a chemical dyeing treatment or a method of coloring an oxide film formed on the aluminum article; and (D) a method of printing the surface of the aluminum material with a paint or other coloring agent by screen printing or transfer printing.

And also, there is known a method of sticking a grain-like printed paper or film on the surface of the aluminum article. Among them, however, the method (A) is to strongly compress the aluminum article between a pair of dies or molding tools under pressure, so that it is only applicable to flat aluminum articles and also the manufacture of dies or molding tools requires much cost. Furthermore, in the methods (B), (C) and (D), the masking work and the printing of grain-like pattern not only require a great amount of labor, but also the subsequent secondary treatment is very troublesome and further there is a problem in the durability of layers patterned on the aluminum article. In any case, it is necessary to use specific machines and instruments, so that the working cost is very expensive, and particularly the above mentioned methods can not be applied to aluminum articles having complicated forms such as extruded profiles for aluminum sash and the like.

SUMMARY OF THE INVENTION

It is, therefore, an object of the present invention to provide a novel method of treating a surface of an aluminum or aluminum alloy wherein beautiful grain-like or wooden like patterns can easily be formed on the surface thereof by an electrochemical means without using the above mentioned expensive and troublesome methods such as embossing, engraving, spraying, baking, printing and the like.

According to the present invention, there is provided a method of treating a surface of an aluminum or aluminum alloy, characterized in that the aluminum or aluminum alloy is electrolyzed in an electrolytic bath having a specific conductance of 1 to 100 $m\Omega^{-1}/cm$ and composed of an aqueous solution containing 0.01 to 0.5 mol/l of at least one of hydroxides and salts of an alkali or alkaline earth metal and the bath may include 0.01 to 0.5 mol/l of at least one substance capable of forming a barrier-type layer selected from the group consisting of inorganic acids, organic acids and ammonium salts of weak acids by using an inert meterial as an opposite electrode and applying an alternating current to form a layer having a grain-like pattern on the surface thereof.

In a first preferred embodiment of the present invention, the aluminum article after the formation of grain-like pattern is further subjected to a usual coloration treatment as mentioned below in order to color the grain-like pattern more clearly.

(a) The aluminum article after the formation of grain-like pattern is colored by electrolyzing in a coloring bath containing an inorganic metal salt by an alternating current, which is referred to as "alternating current coloration", or by immersing in a coloring bath containing an inorganic metal salt or a dyestuff or a pigment, which is reference to as "immersion coloration".

(b) The aluminum material after the formation of grain-like pattern is anodically oxidized in an electrolytic bath containing an inorganic acid or an organic acid or a mixture thereof by applying direct current and/or an alternating current, and thereafter colored by the same coloration treatment as described in the above mentioned method (a).

In a second preferred embodiment of the present invention, various grain-like patterns such as straight grain, cross grain, knotty grain and the like is formed on the surface of the aluminum article during the formation of the grain-like pattern by applying an ultrasonic wave to the electrolytic bath or by jetting the same electrolyte to the aluminum article. organic acids and ammonium salts of weak acids by using an inert meterial as an opposite electrode and applying an alternate current to form a layer having a grain-like pattern on the surface thereof.

In a first preferred embodiment of the present invention, the aluminum article after the formation of grain-like pattern is further subjected to a usual coloration treatment as mentioned below in order to color the grain-like pattern more clearly.

(a) The aluminum article after the formation of grain-like pattern is colored by electrolyzing in a coloring bath containing an inorganic metal salt by an alternate current, which is referred to as "alternate current coloration", or by immersing in a coloring bath containing an inorganic metal salt or a dyestuff or a pigment, which is reffered to as "immersion coloration".

(b) The aluminum material after the formation of grain-like pattern is anodically oxidized in an electrolytic bath containing an inorganic acid or an organic acid or a mixture thereof by applying direct current and/or an alternate current, and thereafter colored by the same coloration treatment as described in the above mentioned method (a).

In a second preferred embodiment of the present invention, various grain-like patterns such as straight grain, cross grain, knotty grain and the like is formed on the surface of the aluminum article during the formation of the grain-like pattern by applying an ultrasonic wave to the electrolytic bath or by jetting the same electrolyte to the aluminum article.

BRIEF DESCRIPTION OF THE DRAWINGS

The invention will now be described in greater detail with reference to the accompanying drawings, wherein.

DESCRIPTION OF THE PREFERRED EMBODIMENTS

According to the present invention, the aluminum or aluminum alloy (aluminum article) is first subjected to a pretreatment of degreasing and etching in a usual manner. The thus treated aluminum article is suspended vertically and immersed in an electrolytic bath having a specific conductance of 1 to 100 $m\Omega^{-1}$/cm and composed of an aqueous solution containing 0.01 to 0.5 mol/l of at least one of hydroxides and salts of alkali or alkaline earth metal or further including 0.01 to 0.5 mol/l of at least one substance capable of forming a barrier layer selected from the group consisting of inorganic acids, organic acids and ammonium salts and then electrolyzed by using an inert material as an opposite electrode and applying an alternating current. By such an alternating current electrolysis, a silver-gray grain-like or wooden like pattern is formed on the surface of the aluminum article along the suspending direction (up and down direction) of the article in the bath.

Figure 1:
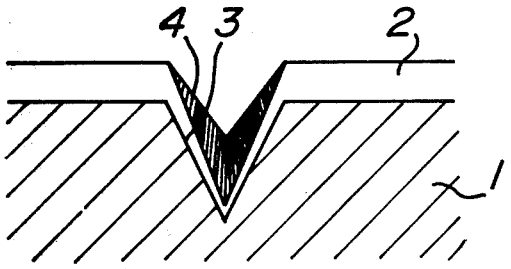
FIG. 1 is a diagrammatically and partially enlarged view for illustrating the cross section of the aluminum article having a grain-like pattern obtained by the alternating current electrolysis according to the inventions.

Though the mechanism of forming the grain-like pattern is not completely understood, the following is considered. A part of the barrier-type layer, which is formed on the surface of the aluminum article at an initial electrolysis stage, is destroyed during the electrolysis to cause the generation of a large number of bubbles. These bubbles rise upwardly along the surface of the aluminum article to the liquid surface in certain traces, so that there is caused a great difference of electrolytic action between the bubble-traced portions and the nontraced portions. As a result, a great number of microcells are formed in the bubble-traced portions rather than the nontraced portions, so that the electrolytic action after the initial electrolysis step substantially centralizes on the bubble-traced portion. When the aluminum article treated by the alternating current electrolysis according to the present invention is observed by an electron microscope, as shown in FIG. 1, the barrier-type layer 2 is formed on the surface of the aluminum article 1, but the porous layer 4 of microcells is formed in the bubble-traced portion 3 due to the centralization of microcells and becomes hollow as compared with the nontraced portions.

As the hydroxide of alkali or alkaline earth metal, use may be made of sodium hydroxide, potassium hydroxide, barium hydroxide and calcium hydroxide. The salts of alkali or alkaline earth metal include, for example, sodium, lithium, potassium, calcium and barium salts of boric acid, sulfuric acid, silicic acid, phosphoric acid, oxalic acid, citric acid, tartaric acid, acetic acid, carbonic acid and the like. Furthermore, as the acid capable of forming such salts, use may be made of sulfamic acid, chromic acid, formic acid, propionic acid, glycolic acid, tungstic acid, selenious acid, phosphomolybdic acid and the like.

The component which contains at least one hydroxide and salt of an alkali or alkaline earth metal has each of the hydroxide or salt used in an amount of 0.01 to 0.5 mol per 1 l of water so as to prepare an electrolytic bath. When the amount is less than 0.01 mol/l, it is necessary to increase the applied voltage because the current flowing becomes less, while when the amount exceeds 0.5 mol/l, the grain-like pattern is not formed because the porous layer is formed over the whole surface of the aluminum article.

When the aluminum article is electrolyzed in such an electrolytic bath by applying an alternating current under conditions as described below, the grain-like pattern may be formed on the surface thereof. However, in order to ensure the reproducibility of the grain-like pattern and to prolong the bath life, it is preferable that at least one substance capable of forming a barrier-type layer selected from the group consisting of inorganic acids, organic acids and ammonium salts of weak acids is further added to the above electrolytic bath.

The inorganic or organic acid capable of forming the barrier-type layer includes boric acid, citric acid, tartaric acid, phthalic acid, malonic acid, maleic acid, adipic acid, itaconic acid, sulfonic acid, sulfosalicylic acid, succinic acid, butyric acid, lactic acid, malic acid and the like. Further, weak acids having a dissociation constant (pKa) of more than 3.0 may also be used. As the ammonium salt of weak acid, use may be made of ammonium tartrate, ammonium citrate, ammonium acetate, ammonium borate, ammonium silicate, ammonium carbonate and the like.

In order to stabilize the electrolytic bath, the substance capable of forming the barrier-type layer is preferably added in an amount of 0.01 to 0.5 mol per 1 l of water. When the amount is less than 0.01 mol/l, the addition effect can not be expected, while the addition of more than 0.5 mol/l is uneconomical.

The components constituting the electrolytic bath may be optionally combined within the above-mentioned concentration range, but the combination of these components must satisfy such a requirement that a specific conductance of the final electrolytic bath is within a range of 1 to 100 $m\Omega^{-1}$/cm. When the specific conductance is less than 1 $m\Omega^{-1}$/cm, it is necessary to increase the applied voltage to an unpractical extent, while when the specific conductance exceeds 100 $m\Omega^{-1}$/cm, the grain-like pattern can not be formed.

With such an electrolytic bath, the aluminum article is subjected to an alternating current electrolysis under the following conditions.

The inert material as an opposite electrode includes, for example, carbon, stainless steel and the like.

The term "alternating current" used herein means a sine wave and waves following an alternating current such as asymmetric rectified wave and pulse shape, the polarity of which is alternately changed into positive and negative states. The alternating current is usually used in a frequency of 30 to 80 Hz. However, the grain-like pattern may be formed even at the frequency beyond this range. In general, the grain-like pattern becomes coarse at lower frequency and fine at higher frequency.

The temperature of the electrolytic bath is 10° to 50° C. and the voltage applied to the bath is 10 to 80 volts, preferably 20 to 60 volts.

The thus obtained aluminum article having at its surface the grain-like pattern can be practically used by coating it with a transparent resin. However, the silver-gray color of the grain-like pattern is different only in the brightness from the color of the aluminum article itself and exhibits a color tone different from that of natural grain pattern, so that the color effect can not be said to be satisfactory. Moreover, the thickness of the barrier-type layer formed only by the above alternating current electrolysis is thin, so that the durability, wear resistance, coloring affinity and the like are poor according to the circumstances.

In order to color the grain-like pattern formed on the surface of the aluminum article to a color tone near to the natural grain pattern, the above treated aluminum article is electrolyzed in a coloring bath containing an inorganic metal salt by applying an alternating current or immersing in a coloring bath containing an inorganic metal salt or a dyestuff or a pigment. Such coloration treatments have been widely utilized in the art for a long time, typical examples of which will be described below. The procedure and conditions of the coloration treatment may be optionally selected in compliance with applications of the aluminum articles.

(1) Alternating current coloration in a coloring bath containing an inorganic metal salt.

The aluminum article after the formation of grain-like pattern is placed in a coloring bath having the following composition and then electrolytically colored at room temperature by using an inert material such as stainless steel, aluminum or carbon as an opposite electrode and applying an alternating current at 10 to 30 volts for 2 to 15 minutes.

| | | |
|---|---|---|
| Bath I: | nickel sulfate | 5–15 g/l |
| | boric acid | 15–25 g/l |
| | sulfosalicylic acid | 2–8 g/l |
| Bath II: | stannous sulfate | 2–8 g/l |
| | ammonium sulfate | 2–6 g/l |
| | citric acid | 10–20 g/l |
| Bath III: | copper sulfate | 5–12 g/l |
| | ammonium sulfate | 15–20 g/l |
| | sulfuric acid | 2–6 g/l |

(2) Immersion coloration in a coloring bath containing an inorganic metal salt.

The aluminum article after the formation of grain-like pattern is immersed in an aqueous solution containing 10 to 20 g/l of ammonium ferric oxalate at a temperature of 50° to 60° C. for 5 to 15 minutes.

Alternatively, the aluminum article is immersed in an aqueous solution containing 100 to 200 g/l of lead nitrate at room temperature for 5 to 15 minutes and then in an aqueous solution containing 50 to 100 g/l potassium permanganate at 70° C. for 3 to 10 minutes.

(3) Immersion coloration in an organic dyestuff bath.

The aluminum article after the formation of grain-like pattern is immersed in an aqueous solution containing 3 to 10 g/l of a watersoluble dyestuff (Aluminium Red Brown, made by Durand & Huguenin A.G.) and having a pH of 5.5 to 7.0 at a temperature of 50° to 60° C. for 2 to 6 minutes.

Moreover, the aluminum article having at its surface the grain-like pattern may be subjected to a protective layer coating treatment prior to the coloration treatment so as to improve the durability and wear resistance. In the formation of the protective layer, the aluminum article is electrolyzed (anodically oxidized) by applying a direct current and/or an alternating current.

In case of anodically oxidizing with direct current, since the barrier-type layer is generally non-porous, a current flowing portion (i.e. current-passing porous layer) is substantially restricted only to the bubble-traced portions. Therefore, the current density becomes considerably small as compared with the case that the aluminum article is anodically oxidized immediately after the conventional pretreatment, so that a long current flowing time is required to form a desired thickness of the anodically oxidized protective layer. Consequently, in order to improve an efficiency of anodic oxidation with direct current, the aluminum article with the previously formed barrier-type layer is treated in a bath containing an electrolyte capable of forming a duplex-type porous layer by applying an alternating current, or subjected to a slight layer thinning treatment and thereafter anodically oxidized by applying a direct current.

When the protective layer is formed by an anodic oxidation with alternating current, there is not required the specific conductive treatment as in the case of the anodic oxidation with direct current. However, the resulting protective layer is relatively soft, so that it is preferable to make the protective layer hard by subjecting it to a further anodic oxidation with direct current.

The anodic oxidation for forming the protective layer will be described below in detail.

As the electrolyte capable of forming the duplex-type porous layer, use may be made of sulfuric acid, oxalic acid and a mixture thereof. For instance, sulfuric acid is used in an amount of 50 to 200 g/l, and oxalic acid is used in an amount of 5 to 50 g/l, and the mixture is used as a mixed acid of 2 to 200 g/l of sulfuric acid and 10 to 30 g/l of oxalic acid.

In the bath containing such an electrolyte is placed the aluminum article having the grain-like pattern and then the anodic oxidation is carried out by applying a direct current or an alternating current at a temperature of 5° to 30° C. to form a protective layer. The inert material as an opposite electrode is carbon in case of the alternating current and carbon, lead and aluminum in case of the direct current. The voltage applied to the bath is 5 to 80 volts, preferably 10 to 40 volts in case of the alternating current and 5 to 50 volts, preferably 10 to 30 volts in case of the direct current.

If the layer thinning treatment is carried out prior to the anodic oxidation, the aluminum article after the formation of grain-like pattern is etched in an aqueous solution containing, for example, 20 to 60 g/l of sodium carbonate or 5 to 50 g/l of sodium hydroxide or 10 to 50 g/l of sodium phosphate at a temperature of 30° to 50° C. As the etching solution, use may be made of sulfuric acid, hydrochloric acid, phosphoric acid and the like.

Figure 2:
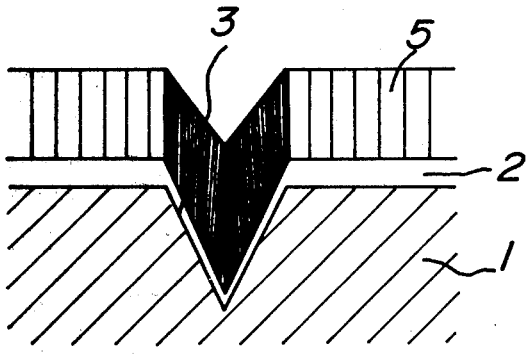
FIG. 2 is a diagrammatically and partially enlarged view for illustrating the cross section of the aluminum article obtained by the anodic oxidation after the alternating current electrolysis according to the invention.

By such anodic oxidation with direct or alternating current, an anodically oxidized porous layer 5 is formed on the surface of the aluminum article having the grain-like pattern as shown in FIG. 2. This layer serves as a protective layer to considerably improve corrosion resistance, wear resistance, durability and the like. Furthermore, by properly selecting conditions of the anodic oxidation, a colored grain-like pattern layer may be formed at this stage. However, in order to make the grain-like pattern more clear, the aluminum article after the anodic oxidation is subjected to the aforementioned coloration treatments.

The reason why the clearness of the grain-like pattern is increased by such coloration treatment is based on the followings. That is, as seen from FIG. 1, the microcells 4 are centralized in the bubble-traced portions 3 corresponding to grains of the grain-like pattern, while the barrier-type layer 2 has less microcell and is nonporous. Furthermore, as seen from FIG. 2, the microcells are considerably distributed into the grain portions by the anodic oxidation for forming the protective layer. Consequently, the inorganic metal salt, dyestuff or pigment is concentrically deposited on or adhered to the grain portions in proportion to the distribution of microcells.

Since the grain-like pattern is formed on the surface of the aluminum article along the bubble-rising traces generated during the alternating current electrolysis as mentioned above, any grain-like patterns such as straight grain, cross grain, knotty grain and the like can be formed by delicately moving the electrolyte at this electrolysis step so as to change the traces of bubbles. For this purpose, the electrolyte may be delicately stirred by applying an ultrasonic wave to the electrolytic bath or by jetting the same electrolyte to the aluminum article during the alternating current electrolysis according to the present invention. In case of using of ultrasonic wave, the frequency is 20 to 50 KHz and power is 0.5 to 5 watt/cm$^2$. Beyond these ranges, the desired grain-like pattern can not be obtained.

According to the present invention, various and peculiar grain-like patterns such as straight grain, cross grain, knotty grain and the like can freely be formed on the surface of the aluminum article by means of an electrochemical treatment and further may be colored more clearly by conventional well-known coloration treatments. Furthermore, the present invention does not require specific machines and instruments and manual operation as compared with the conventional pattern-formation methods, so that the productivity is considerably improved and the aluminum article having at its surface a beautiful grain-like pattern can be efficiently manufactured at a lower cost. And also, the present invention does not use originals, prints and the like as in the conventional embossing, engraving, masking and printing processes, so that the resulting grain-like pattern can be considered to be the same as the natural grain pattern because it is not standardized and has no artificial patterns formed by repeating the same pattern. Moreover, if the coloration treatment is carried out after the anodic oxidation, a coloring agent having a high color fastness to light can be used, so that the weather resistance is considerably improved. Accordingly, the present invention has a best utility value for the manufacture of not only aluminum sash, panels and fixtures for building construction, but also decorative aluminum articles for vehicles, household articles and the like.

The following examples are given in illustration of this invention and are not intended as limitations thereof. In general, it is a common practice that the aluminum article is subjected to an alternating current electrolysis for the formation of grain-like pattern and subsequent anodic oxidation and/or coloration treatment, so that the examples will be described with respect to such combined treatments.

EXAMPLE 1

Aluminum 6063S-$T_5$ extruded bar was degreased in a usual manner and then electrolyzed in an aqueous solution containing 0.4 mol/l of sodium metaborate by using a stainless steel plate as an opposite electrode and applying an alternating current at an initial current density of 2.0 A/dm$^2$ for 15 minutes to form a grain-like pattern on the aluminum extruded bar.

The thus treated aluminum extruded bar was electrolytically colored in a coloring bath containing 4 g/l of stannous sulfate, 10 g/l of citric acid and 4 g/l of ammonium sulfate by applying an alternating current at 15 volts for 3 minutes and finally subjected to a dip coating with an acrylic clear lacquer, whereby the aluminum extruded bar having a beautiful colored grain-like pattern was obtained.

EXAMPLE 2

Aluminum 6063S-$T_5$ extruded bar was degreased in a usual manner and then electrolyzed in an aqueous solution containing 10 g/l of sodium silicate and 5 g/l of phthalic acid by using a stainless steel plate as an opposite electrode and applying an alternating current at an initial current density of 2.0 A/dm$^2$ for 5 minutes to form a grain-like pattern on the aluminum extruded bar.

The thus treated aluminum extruded bar was electrolytically colored in a coloring bath containing 4 g/l of stannous sulfate, 10 g/l of citric acid and 4 g/l of ammonium sulfate by applying an alternate current at 15 volts for 3 minutes and finally subjected to a dip coating with an acrylic clear lacquer, whereby the aluminum extruded bar having a beautiful colored grain-like pattern was obtained.

EXAMPLE 3

Aluminum 6063S-$T_5$ extruded bar was degreased in a usual manner and then electrolyzed in an aqueous solution containing 1 g/l of calcium hydroxide, 5 g/l of sodium carbonate and 5 g/l of phthalic acid by using a stainless steel plate as an opposite electrode and applying an alternating current at an initial current density of 2.0 A/dm$^2$ for 15 minutes to form a grain-like pattern on the aluminum extruded bar.

The thus treated aluminum extruded bar was electrolytically colored in a coloring bath containing 4 g/l of stannous sulfate, 10 g/l of citric acid and 4 g/l of ammonium sulfate by applying an alternating current at 15 volts for 3 minutes and finally subjected to a dip coating with an acrylic clear lacquer, whereby the aluminum extruded bar having a beautiful colored grain-like pattern was obtained.

EXAMPLE 4

Aluminum 1050P-$H_{14}$ plate was degreased in a usual manner and then electrolyzed in an aqueous solution containing 30 g/l of sodium hydrogenphosphate and 10 g/l of sodium gluconate by using a stainless steel plate as an opposite electrode and applying an alternating current at an initial current density of 1.5 A/dm$^2$ for 10 minutes to form a grain-like pattern on the aluminum plate.

The thus treated aluminum plate was immersed in an aqueous solution containing 30 g/l of sodium hydroxide at 60° C. for 1 minute, washed with water, anodically oxidized in an aqueous solution containing 150 g/l of sulfuric acid by applying a direct current at 17 volts for 30 minutes, again washed with water, electrolytically colored in a coloring bath containing 4 g/l of stannous sulfate, 10 g/l of citric acid and 4 g/l of ammonium sulfate by applying an alternating current at 15 volts for 3 minutes and finally treated with a boiling purified water for 30 minutes, whereby the aluminum plate having a beautiful bronze-colored grain-like pattern was obtained.

Example 5

Aluminum 1100P-$H_{14}$ plate was degreased in a usual manner and then electrolyzed in an aqueous solution containing 10 g/l of sodium orthosilicate and 30 g/l of sodium tartrate by using a stainless steel plate as an opposite electrode and applying an alternate current at an initial current density of 3.0 A/dm$^2$ for 15 minutes to form a grain-like pattern on the aluminum plate.

The thus treated aluminum plate was immersed in an aqueous solution containing 30 g/l of sodium hydroxide at 60° C. for 1 minute, washed with water, anodically oxidized in an aqueous solution containing 150 g/l of sulfuric acid by applying a direct current at 17 volts for 30 minutes, electrolytically colored in a coloring bath containing 10 g/l of nickel sulfate, 6 g/l of sulfosalicylic acid and 20 g/l of boric acid by applying an alternating current at 15 volts for 5 minutes and then electrophoretically painted with an acrylic clear lacquer, whereby the aluminum plate having a beautiful amber-colored grain-like pattern was obtained.

EXAMPLE 6

Aluminum 6063S-$T_5$ extruded bar was degreased in a usual manner and then electrolyzed in an aqueous solution containing 30 g/l of sodium triphosphate and 8 g/l of sodium fluoride by using a carbon plate as an opposite electrode and applying an alternating current at an initial current density of 1.5 A/dm$^2$ for 20 minutes to form a grain-like pattern on the aluminum extruded bar.

The thus treaded aluminum extruded bar was immersed in an aqueous solution containing 30 g/l of sodium hydroxide at 60° C. for 1 minute, washed with water, anodically oxidized in an aqueous solution containing 150 g/l of sulfuric acid by applying a direct current at 17 volts for 30 minutes, electrolytically colored in a coloring bath containing 10 g/l of nickel sulfate, 6 g/l of sulfosalicylic acid and 20 g/l of boric acid by applying an alternating current at 15 volts for 5 minutes and finally treated with a boiling purified water, whereby the aluminum extruded bar having a beautiful amber-colored grain-like pattern was obtained.

EXAMPLE 7

Aluminum 1200P-$H_{14}$ plate was degreased in a usual manner and then electrolyzed in an aqueous solution containing 2 g/l of sodium hydroxide and 5 g/l of sodium oleate by using a stainless steel plate as an opposite electrode and applying an alternating current at an initial current density of 2.0 A/dm$^2$ for 20 minutes to form a grain-like pattern on the aluminum plate.

The thus treated aluminum plate was immersed in an aqueous solution containing 30 g/l of sodium hydroxide at 60° C. for 1 minute, washed with water, anodically oxidized in an aqueous solution containing 150 g/l of sulfuric acid by applying a direct current at 17 volts for 30 minutes, electrolytically colored in a coloring bath containing 10 g/l of copper sulfate, 15 g/l of ammonium sulfate and 3 g/l of sulfuric acid by applying an alternating current at 13 volts for 4 minutes and finally electrophoretically painted with an acrylic clear lacquer, whereby the aluminium plate having a beautiful maroon-colored grain-like pattern was obtained.

EXAMPLE 8

Aluminum 6063S-$T_5$ extruded bar was degreased in a usual manner and then electrolyzed in an aqueous solution containing 0.2 mol/l of sodium metaborate and 3 g/l of boric acid by using a stainless steel plate as an opposite electrode and applying an alternating current at an initial current density of 2.0 A/dm$^2$ for 15 minutes to form a grain-like pattern on the aluminum extruded bar.

The thus treated aluminum extruded bar was immersed in an aqueous solution containing 30 g/l of sodium hydroxide at 60° C. for 1 minute, washed with water, anodically oxidized in an aqueous solution containing 150 g/l of sulfuric acid by applying a direct current at 17 volts for 30 minutes, immersed in a coloring bath containing 15 g/l of ammonium ferric oxalate at 60° C. for 10 minutes and finally treated with a boiling purified water, whereby the aluminum extruded bar having a beautiful light yellowish white-colored grain-like pattern was obtained.

EXAMPLE 9

Aluminum 6063S-$T_5$ extruded bar was degreased in a usual manner and then electrolyzed in an aqueous solution containing 0.3 mol/l of citric acid and 10 g/l of sodium hydroxide by using a stainless steel plate as an opposite electrode and applying an alternating current at an initial current density of 2.0 A/dm$^2$ for 15 minutes to form a grain-like pattern on the aluminum extruded bar.

The thus treated aluminum extruded bar was immersed in an aqueous solution containing 40 g/l of sodium carbonate at 45° C. for 2 minutes, washed with water, anodically oxidized in an aqueous solution containing 150 g/l of sulfuric acid by applying a direct current at 17 volts for 30 minutes, electrolytically colored in a coloring bath containing 30 g/l of copper sulfate and 20 g/l of sulfamic acid by applying an alternating current at 14 volts for 3 minutes and finally treated with a boiling purified water, whereby the aluminum extruded bar having a beautiful brown-colored grain-like pattern was obtained.

EXAMPLE 10

Aluminum 6063S-$T_5$ extruded bar was degreased in a usual manner and then electrolyzed in an aqueous solution containing 0.3 mol/l of sodium triphosphate and 5 g/l of butanic acid by using a stainless steel plate as an opposite electrode and applying an alternating current at an initial current density of 2.0 A/dm$^2$ for 15 minutes to form a grain-like pattern on the aluminum extruded bar.

The thus treated aluminum extruded bar was immersed in an aqueous solution containing 30 g/l of sodium hydroxide at 60° C. for 1 minute, washed with water, anodically oxidized in an aqueous solution containing 150 g/l of sulfuric acid by applying a direct current at 17 volts for 20 minutes, electrolytically colored in a coloring bath containing 20 g/l of nickel acetate and 5 g/l of boric acid by applying an alternating current at 16 volts for 6 minutes and finally treated with a boiling purified water, whereby the aluminum extruded bar having a beautiful brown-colored grain-like pattern was obtained.

EXAMPLE 11

Aluminum 6063S-$T_5$ extruded bar was degreased in a usual manner and then electrolyzed in an aqueous solution containing 0.1 mol/l of tartaric acid and 5 g/l of sodium carbonate by using a carbon plate as an opposite electrode and applying an alternating current at an initial current density of 2.0 A/dm$^2$ for 20 minutes to form a grain-like pattern on the aluminum extruded bar.

The thus treated aluminum extruded bar was immersed in an aqueous solution containing 30 g/l of sodium hydroxide at 60° C. for 1 minute, washed with water, anodically oxidized in an aqueous solution containing 150 g/l of sulfuric acid by applying a direct current at 17 volts for 30 minutes, immersed in a coloring bath containing 1.5 g/l of silver sulfate at 60° C. for 7 minutes and finally treated with a boiling purified water, whereby the aluminum extruded bar having a beautiful brown-colored grain-like pattern was obtained.

EXAMPLE 12

Aluminum 1050P-$H_{14}$ plate was degreased in a usual manner and then electrolyzed in an aqueous solution containing 0.3 mol/l of adipic acid and 10 g/l of sodium triphosphate by using a platinum plate as an opposite electrode and applying an alternating current at an initial current density of 3.0 A/dm$^2$ for 15 minutes to form a grain-like pattern on the aluminum plate.

The thus treated aluminum plate was immersed in an aqueous solution containing 50 g/l of sodium carbonate at 50° C. for 2 minutes, washed with water, anodically oxidized in an aqueous solution containing 150 g/l of sulfuric acid by applying a direct current at 17 volts for 30 minutes, immersed in a coloring bath containing 15 g/l of ammonium ferric oxalate at 60° C. for 10 minutes and finally treated with a boiling purified water, whereby the aluminum plate having a beautiful light yellowish white-colored grain-like pattern was obtained.

EXAMPLE 13

Aluminum 6063S-$T_5$ extruded bar was degreased in a usual manner and then electrolyzed in an aqueous solution containing 0.3 mol/l of citric acid and 0.3 mol/l of sodium triphosphate by using a stainless steel plate as an opposite electrode and applying an alternating current with a frequency of 60 Hz at 23 volts for 15 minutes to form a grain-like pattern on the aluminum extruded bar.

The thus treated aluminum extruded bar was electrolytically colored in a coloring bath containing 4 g/l of stannous sulfate, 10 g/l of citric acid and 4 g/l of ammonium sulfate by applying an alternating current at 15 volts for 3 minutes, whereby the aluminum extruded bar having a beautiful colored grain-like pattern was obtained. Finally, this aluminum extruded bar was subjected to a dip coating with an acrylic clear lacquer.

EXAMPLE 14

Aluminum 1050P-$H_{14}$ plate was degreased in a usual manner and then electrolyzed in an aqueous solution containing 0.1 mol/l of tartaric acid and 0.3 mol/l of lithium oxalate by using a carbon plate as an opposite electrode and applying an alternating current with a frequency of 30 Hz at an initial current density of 2.0 A/dm$^2$ for 15 minutes to form a grain-like pattern on the aluminum plate.

The thus treated aluminum plate was immersed in a coloring bath containing 15 g/l of ammonium ferric oxalate at 60° C. for 10 minutes, whereby the aluminum plate having a beautiful colored grain-like pattern was obtained. Finally, this aluminum plate was subjected to a spray coating with a light yellow clear lacquer.

EXAMPLE 15

Aluminum 6063S-$T_5$ extruded bar was degreased in a usual manner and then electrolyzed in an aqueous solution containing 0.1 mol/l of succinic acid and 0.03 mol/l of sodium hydroxide by using a stainless steel plate as an opposite electrode and applying an alternating current with a frequency of 60 Hz at 30 volts for 10 minutes to form a grain-like pattern on the aluminum extruded bar.

The thus treated aluminum extruded bar was anodically oxidized in an aqueous solution containing 150 g/l of sulfuric acid by using a carbon plate as an opposite electrode and applying an alternating current with a frequency of 60 Hz at 10 volts for 30 minutes and then electrolytically colored in a coloring bath containing 10 g/l of copper sulfate, 15 g/l of ammonium sulfate and 3 g/l of sulfuric acid by applying an alternating current at 13 volts for 4 minutes, whereby a deeply maroonish brown-colored grain-like pattern was obtained. Finally, this aluminum extruded bar was electrophoretically painted with an acrylic clear lacquer.

EXAMPLE 16

Aluminum 6063S-$T_5$ extruded bar was degreased in a usual manner and then electrolyzed in an aqueous solution containing 0.3 mol/l of sodium metaborate and 0.1 mol/l of boric acid by using a stainless steel plate as an opposite electrode and applying an alternating current with a frequency of 60 Hz at 30 volts for 15 minutes to form a grain-like pattern of the aluminum extruded bar.

The thus treated aluminum extruded bar was immersed in an aqueous solution containing 40 g/l of sodium carbonate at 45° C. for 2 minutes, anodically oxidized in an aqueous solution containing 150 g/l of sulfuric acid by applying a direct current at 16 volts for 30 minutes and then electrolytically colored in a coloring bath containing 4 g/l of stannous sulfate, 10 g/l of citric acid and 4 g/l of ammonium sulfate by applying an alternating current at 15 volts for 3 minutes, whereby the aluminum extruded bar having a deeply amber-colored grain-like pattern was obtained. Finally, this aluminum extruded bar was electrophoretically painted with an acrylic clear lacquer.

EXAMPLE 17

Aluminum 1100-$H_{14}$ plate was degreased in a usual manner and then electrolyzed in an aqueous solution containing 0.1 mol/l of sulfosalicylic acid and 0.1 mol/l of Rochelle salt by using a stainless steel plate as an opposite electrode and applying an alternating current at an initial current density of 2.0 A/dm$^2$ for 15 minutes to form a grain-like pattern on the aluminum plate.

The thus treated aluminum plate was anodically oxidized in an aqueous solution containing 150 g/l of sulfuric acid and 10 g/l of oxalic acid by using a carbon plate as an opposite electrode and applying an alternating current at 10 volts for 15 minutes and further a direct current at 17 volts for 20 minutes and then immersed in a coloring bath containing 10 g/l of watersoluble dyestuff (Aluminum Red Brown, made by Durand & Huguenin A. G.) at 50° C. for 6 minutes, whereby the aluminum plate having a beautiful deeply colored grain-like pattern was obtained. Finally, this aluminum plate was subjected to a dip coating with an acrylic clear lacquer.

EXAMPLE 18

Aluminum 6063S-$T_5$ extruded bar was degreased in a usual manner and then electrolyzed in an aqueous solution containing 5 g/l of boric acid and 30 g/l of sodium metaborate by using a stainless steel plate as an opposite electrode and applying an alternating current at 30 volts for 10 minutes to form a grain-like pattern on the aluminum extruded bar.

The thus treated aluminum extruded bar was anodically oxidized in an aqueous solution containing 150 g/l of sulfuric acid by applying an alternating current at 10 volts for 40 minutes, electrolytically colored in a coloring bath containing 6 g/l of sulfosalicylic acid, 20 g/l of boric acid and 10 g/l of nickel sulfate by applying an alternating current at 15 volts for 5 minutes and finally subjected to an electrophoretic painting treatment, whereby the aluminum extruded bar having a beautiful deeply colored grain-like pattern was obtained.

EXAMPLE 19

Aluminum 6063S-$T_5$ extruded bar was degreased in a usual manner and then electrolyzed in an aqueous solution containing 6 g/l of boric acid, 30 g/l of sodium metaborate and 7 g/l of sodium sulfate by using a stainless steel plate as an opposite electrode and applying an alternating current at 30 volts for 10 minutes to form a grain-like pattern on the aluminum extruded bar.

The thus treated aluminum extruded bar was anodically oxidized in an aqueous solution containing 150 g/l of sulfuric acid by applying a pulse shaped voltage with a positive amplitude of 16 V and a negative amplitude of 10 V each having a duration of 2 seconds for 30 minutes, immersed in a coloring bath containing 1.5 g/l of silver sulfate at 60° C. for 7 minutes and then electrostatically coated, whereby the aluminum extruded bar having a beautiful light brown-colored grain-like pattern was obtained.

EXAMPLE 20

Aluminum 6063S-$T_5$ extruded bar was degreased in a usual manner and then electrolyzed in an aqueous solution containing 18 g/l of boric acid and 1 g/l of sodium hydroxide by using a stainless steel plate as an opposite electrode and applying an alternating current at 35 volts for 10 minutes to form a grain-like pattern on the aluminum extruded bar.

The thus treated aluminum extruded bar was anodically oxidized in an aqueous solution containing 150 g/l of sulfuric acid and 10 g/l of oxalic acid by applying an alternating current at 10 volts for 5 minutes and further a direct current at 16 volts for 30 minutes, immersed in a coloring bath containing 20 g/l of ammonium ferric oxalate at 60° C. for 20 minutes and finally subjected to a dip coating with an acrylic clear lacquer, whereby the aluminum extruded bar having a beautiful colored grain-like pattern, wherein the grain portions are orange and the other portions are light yellow, was obtained.

EXAMPLE 21

Aluminum 1050P-$H_{14}$ plate was degreased in a usual manner and then electrolyzed in an aqueous solution containing 10 g/l of boric acid and 7 g/l of sodium sulfate by using a carbon plate as an opposite electrode and applying an alternating current at 25 volts for 10 minutes to form a grain-like pattern on the aluminum plate.

The thus treated aluminum plate was anodically oxidized in an aqueous solution containing 150 g/l of sulfuric acid by applying an alternating current at 7 volts for 5 minutes and further a direct current at 16 volts for 30 minutes, electrolytically colored in a coloring bath containing 10 g/l of citric acid, 4 g/l of ammonium sulfate and 4 g/l of stannous sulfate by applying an alternating current at 15 volts for 3 minutes and finally treated with a boiling purified water, whereby the aluminum plate having a beautiful amber-colored grain-like pattern was obtained.

EXAMPLE 22

Aluminum 6063S-$T_5$ extruded bar was degreased in a usual manner and then electrolyzed in an aqueous solution containing 0.2 mol/l of sodium metaborate and 3 g/l of boric acid by using a stainless steel plate as an opposite electrode and applying an alternating current at an initial current density of 2.0 A/dm$^2$ for 15 minutes, while applying an ultrasonic wave of 30 KHz from the lower part of the bath, to form a cross grain-like pattern on the aluminum extruded bar.

The thus treated aluminum extruded bar was immersed in an aqueous solution containing 30 g/l of sodium hydroxide at 60° C. for 1 minute, washed with water, anodically oxidized in an aqueous solution containing 150 g/l of sulfuric acid by applying a direct current at 17 volts for 30 minutes, immersed in a coloring bath containing 15 g/l of ammonium ferric oxalate at 60° C. for 10 minutes and finally treated with a boiling purified water, whereby the aluminum extruded bar having a beautiful light yellow-colored cross grain-like pattern was obtained.

EXAMPLE 23

Aluminum 6063S-$T_5$ extruded bar was degreased in a usual manner and then electrolyzed in an aqueous solution containing 0.3 mol/l of citric acid and 10 g/l of sodium hydroxide by using a stainless steel plate, as an opposite electrode and applying an alternating current at an initial current density of 2.0 A/dm$^2$ for 15 minutes, while applying an ultrasonic wave of 20 KHz at the middle position of the bath, to form a knotty grain-like pattern on the aluminum extruded bar.

The thus treated aluminum extruded bar was immersed in an aqueous solution containing 40 g/l of sodium carbonate at 45° C. for 2 minutes, washed with water, anodically oxidized in an aqueous solution containing 150 g/l of sulfuric acid by applying a direct current at 17 volts for 30 minutes, electrolytically colored in a coloring bath containing 30 g/l of copper sulfate and 20 g/l of sulfamic acid by applying an alternating current at 13 volts for 4 minutes and finally subjected to a usual electrophoretic painting treatment, whereby the aluminum extruded bar having a beautiful brown-colored knotty grain-like pattern was obtained.

EXAMPLE 24

Aluminum 6063S-$T_5$ extruded bar was degreased in a usual manner and then electrolyzed in an aqueous solution containing 0.3 mol/l of sodium triphosphate and 5 g/l of butyric acid by using a stainless steel plate as an opposite electrode and applying an alternating current at an initial current density of 2.0 A/dm$^2$ for 15 minutes, while jetting the same electrolyte to the aluminum extruded bar at a rate of 50 m/sec from an orifice of 3 mm diameter at the middle position of the bath, to form a knotty grain-like pattern on the aluminum extruded bar.

The thus treated aluminum extruded bar was anodically oxidized in an aqueous solution containing 150 g/l of sulfuric acid by applying an alternating current at 10 volts for 5 minutes and further a direct current at 17 volts for 20 minutes, electrolytically colored in a coloring bath containing 20 g/l of nickel sulfate and 5 g/l of boric acid by applying an alternating current at 15 volts for 5 minutes and finally treated with a boiling purified water, whereby the aluminum extruded bar having a beautiful brown-colored knotty grain-like pattern was obtained.

What is claimed is:

1. A method of treating a surface of an aluminum or aluminum alloy, characterized in that the aluminum or aluminum alloy is electrolyzed in an electrolytic bath having a specific conductance of 1 to 100 $m\Omega^{-1}/cm$ and comprising an aqueous solution containing at least one of the group consisting of alkali metal hydroxides, alkaline-earth metal hydroxides, alkali metal salts and alkaline-earth metal salts, the concentration of each of said hydroxide or said salt of alkali or alkaline earth metal being 0.01 to 0.5 mol/l, at a bath temperature of 10 to 50° C. by using an inert material as an opposite electrode and applying an alternating current of 10 to 80 volts to form a layer having a grain-like pattern on the surface of the aluminum or aluminum alloy.

2. The method as claimed in claim 1, wherein said aqueous solution further contains 0.01 to 0.5 mol/l of at least one substance capable of forming a barrier-type layer selected from the group consisting of inorganic acids, organic acids and ammonium salts of weak acids.

3. The method as claimed in claim 2, wherein said substance capable of forming a barrier-type layer is selected from the group consisting of boric acid, citric acid, tartaric acid, phthalic acid, malonic acid, maleic acid, adipic acid, itaconic acid, sulfonic acid, sulfosalicylic acid, succinic acid, butyric acid, lactic acid, malic acid, ammonium tartrate, ammonium citrate, ammonium acetate, ammonium borate, ammonium silicate and ammonium carbonate.

4. The method as claimed in claim 1, wherein said hydroxide of alkali or alkaline earth metal is sodium hydroxide, potassium hydroxide, barium hydroxide or calcium hydroxide and said salt of alkali or alkaline earth metal is a sodium, potassium, lithium, calcium or barium salt of boric acid, sulfuric acid, silicic acid, oxalic acid, citric acid, tartaric acid, acetic acid, carbonic acid or phosphoric acid.

5. The method as claimed in claim 1, wherein a subsequent coloration treatment is carried out by electrolyzing in a coloring bath containing an inorganic metal salt by an alternating current or by immersing in a coloring bath containing an inorganic metal salt, a dyestuff or a pigment.

6. The method as claimed in claim 1, wherein a subsequent coloration treatment is carried out by anodically oxidizing in an electrolytic bath containing a substance capable of permitting the formation of a duplex-type porous layer by applying an alternating current and/or a direct current to form an anodically oxidized protective layer, and then electrolyzing in a coloring bath containing an inorganic metal salt by an alternating current or immersing in a coloring bath containing an inorganic metal salt, a dyestuff or a pigment.

* * * * *